US005085181A

United States Patent [19]

Feuling

[11] Patent Number: 5,085,181

[45] Date of Patent: Feb. 4, 1992

[54] ELECTRO/HYDRAULIC VARIABLE VALVE TIMING SYSTEM

[75] Inventor: James J. Feuling, Ventura, Calif.

[73] Assignee: Feuling Engineering, Inc., Ventura, Calif.

[21] Appl. No.: 539,238

[22] Filed: Jun. 18, 1990

[51] Int. Cl.[5] ..... F01L 1/34; F01L 9/02

[52] U.S. Cl. ..... 123/90.12; 123/90.15

[58] Field of Search ..... 123/90.12, 90.13, 90.15, 123/90.16, 196 S

[56] References Cited

U.S. PATENT DOCUMENTS

| | | | |
|---|---|---|---|
| 3,682,152 | 8/1972 | Muller-Berner | 123/90.12 |
| 3,817,228 | 6/1974 | Bywater | 123/90.16 |
| 3,865,088 | 2/1975 | Links | 123/90.15 |
| 4,106,446 | 8/1978 | Yamada et al. | 123/90.13 |
| 4,188,925 | 2/1980 | Jordan | 123/90.15 |
| 4,258,671 | 3/1981 | Takizawa et al. | 123/90.16 |
| 4,333,430 | 6/1982 | Rosquist | 123/90.16 |
| 4,466,390 | 8/1984 | Babitzka et al. | 123/90.16 |
| 4,531,485 | 7/1985 | Murther | 123/196 S |
| 4,615,306 | 10/1986 | Wakeman | 123/90.16 |
| 4,696,265 | 9/1987 | Nohira | 123/90.12 |
| 4,930,465 | 6/1990 | Wakeman et al. | 123/90.12 |

FOREIGN PATENT DOCUMENTS

| | | | |
|---|---|---|---|
| 0115415 | 7/1984 | Japan | 123/90.16 |
| 0115416 | 7/1984 | Japan | 123/90.16 |
| 0188016 | 10/1984 | Japan | 123/90.12 |
| 0224411 | 12/1984 | Japan | 123/90.12 |

*Primary Examiner*—E. Rollins Cross
*Assistant Examiner*—Weilun Lo
*Attorney, Agent, or Firm*—Frank D. Gilliam

[57] ABSTRACT

In an internal combustion engine utilizing hydraulic valve lifters, a source of pressurized engine oil at a higher than normally expected pressure is supplied thereto. The oil delivered to the lifter galley is derived from either an engine oil pump which produces a higher pressure oil flow then conventionally desired for normal engine operation or a separate oil pump. The pressure setting of the oil output from either pump is determined by the engine RPM, i.e. higher pressure with higher engine RPM or from pump speed if an electrically operated separate pump is employed. The exact oil pressure level delivered to the valve galley or to individual valve galleys is determined by an on board computer (engine controller) monitoring the manifold pressure, engine RPM and throttle position so that the hydraulic lifter plunger maintains contact with the valve stem regardless of engine RPM or pump motor speed and variable and different amounts oil pressure and resulting valve lift can be achieved at various selected locations on the valve lift curve created by the valve's camshaft lobe. Variable high oil pressure is supplied only to the lifters to selectively alter their normal degree of valve lift at any location along the valve's cam operating curve while the remaining oil delivery areas of the engine operate at their normally expected oil pressure levels. In event of a failure of normal engine oil pump operation when a second auxiliary pump for galley delivery is used, an electric valve is provided to channel oil from the auxiliary pump to the engine areas requiring lubrication.

11 Claims, 1 Drawing Sheet

ELECTRO/HYDRAULIC VARIABLE VALVE TIMING SYSTEM

BACKGROUND OF THE INVENTION

The invention is directed generally to internal combustion engines and more particularly to those engines that employ hydraulic valve lifters for valve lifter operation which require a source of oil to be delivered under pressure thereto. Hydraulic valve lifters are well known the engine art and, therefore, will not be discussed in any great detail herein.

In state of the art engines employing hydraulic valve lifters, oil under pressure is supplied to the lifters from the engine oil pump. For new engines and engines with fresh oil this means for supplying oil the hydraulic lifters is generally satisfactory for average engine operation. However, when the oil gets old, or extremely hot or the engine begins to wear the normal oil pressure supplied from a conventional engine oil pump drops in pressure. This drop in pressure reduces flow of oil and the pressure of that oil delivered to the lifters resulting in less lifter movement and/or the hydraulic lifter plunger loosing contact with the valve stems at certain engine RPM resulting in a change in the normally expected valve timing at various speeds.

Generally the function of the hydraulic lifter is to maintain physical contact between the valve drive link(s), ie. between the cam lobes and valve stems or rocker ends to reduce valve actuation mechanical noise and to continually make adjustments for gear and valve link wear while maintaining that physical contact. No consideration is given to change or intentional modifying valve lifter operation to overcome inaccurate valve timing at various RPM where slight valve stem length adjustment is necessary to cause slightly different valve timing and lift for ideal operation engine operation at different RPMs.

Other methods of variable valve timing include advance and retard systems, multi-profile cams, solenoid/-helenoid actuated valves, and high leak hydraulic lifters.

The present invention fills a long felt need for a valve lifter system that compensates for engine wear and the resulting low oil pressure delivered to the valve lifters and the need to control the degree of lift of the valves through the lifters during valve opening and closing at different engine RPM.

SUMMARY OF THE INVENTION

The invention is directed to an independent supply of engine oil under pressure to supply the hydraulic valve lifters with a selected level of oil pressure at all times independent of engine lubrication oil pressure, engine oil conditions or engine RPM.

Commonly, oil lines and passages are provided from the output side of the conventional engine oil pump to the block or head where the hydraulic lifters are located. The oil draining from the hydraulic lifters during their operation is returned to the engine sump or crank case. In the present invention in a first embodiment, a conventional engine oil pump is employed that has a higher than normally expected oil output pressure. The pump output is bifurcated with a portion of the oil output being supplied to the normal areas requiring ongoing lubrication as in a conventional engine and the other half being supplied to the hydraulic lifter galley. A regulated pressure relief valve prevents excessive oil pressures levels from entering the conventional engine ongoing lubrication areas. A computer with a sensor and bypass valve regulates the pressure of the oil flowing to the hydraulic lifter galley. If greater valve lift is required at any position along the valve lift curve the galley pressure is increased and if less valve lift is required, the galley pressure is reduced. Additional sensors measure engine RPM, manifold pressure, and throttle position.

In a first embodiment, the hydraulic lifter galley supply channel from the conventional engine oil pump is disconnected or re-routed from the output of the conventional engine lubrication oil pump and are connected to and supplied engine oil by a separate independent oil pump being continually fed from the engine sump or crank case. The independent oil pump can either be electric or mechanical. The desired pressure can be maintained with an electric pump by controlling the pump RPM or maintaining a desired oil pressure from a constant speed pump by bleeding excess pressure from or prior to delivery to the sump. When a mechanical pump is employed for the lifter galley supply it is geared to engine rotation so as to develop a higher than required pressure even at low engine RPMs whereby the desired pressure is maintained as mentioned hereinbefore by by-passing a selected amount of pressurized oil back to the sump as required to maintain the desired galley pressure. With the use of either oil pump system described or similar pumping, an on board controller or computer is used to monitor the engine RPM and control the pump output oil pressure to the hydraulic lifters accordingly.

The system of the present invention is capable of developing hydraulic lifter oil pressure high enough to increase or decrease the normal expected valve lift from a hydraulic lifter at any location along the cam lift curve resulting in selected timing of and duration of valve opening and closing. This feature is very important when extremely low or high engine RPM is desired, ie. in town and high speed highway driving respectfully. For example, with high pressures the valve actuating plunger of the lifter can be varied in elevation approximately one hundred thousandths of an inch creating desired ideal valve opening durations for high RPM which has the effect of extending the valve stem or the pressure can be lowered for low RPM so that the plunger merely makes contact with the valve actuating rod at a minimum pressure providing in effect approximately one hundred thousandths of an inch effective shorting of the valve actuation length thereby increasing the valve opening duration and area under the curve.

In the first embodiment an electric valve is included to provide for normal engine lubrication in the event of engine oil pump failure. The valve operates by receiving a signal from the oil pressure sensor normally in a vehicle when ground is detected due to lack of oil pressure or from the registration of zero oil pressure from an oil pressure gauge.

In a second embodiment, a conventional engine oil pump is employed that has a higher than normally expected oil output pressure. The pump output is bifurcated with half of the out put being supplied to the normal areas requiring ongoing lubrication as in a conventional engine and the other half being supplied to the hydraulic lifter galley. A regulated pressure relief valve prevents excessive oil pressures levels from entering the conventional engine ongoing lubrication areas. As in the first embodiment, a computer with a pressure sensor regulates the pressure of the oil flowing to the hydraulic lifter galley of all or individual valve lifter galleys. If greater valve lift is required the galley pressure if increased and if less valve lift is required, the galley pressure is reduced.

The variable valve timing system of the present invention can be produced at low cost, is easy to adapt to existing engines, can control the intake and exhaust valves independently, is quiet in operation, reliable to perform as expected, provides major improvements in fuel mileage, reductions in unwanted emissions, provides better engine idle, more useable power from a given engine and better starting.

An object of the present invention is to provide an independent source of oil under pressure to the hydraulic lifters of an internal combustion engine or the like.

Another object of the invention is to provide an independent oil supply to the hydraulic valve lifters of an internal combustion engine the pressure of which can be selected through a wide range of different pressures regardless of the internal engine oil pressure used for conventional engine lubrication.

Another object of the present invention is to provide a source of oil for the hydraulic valve lifters of an internal combustion engine the pressure of which is independent of the RPM of the internal combustion engine.

Still another object of the invention is to provide a means for effectively changing the degree of lift of a valve by means of oil pressure changes to the hydraulic valve lifters.

Yet another object of the invention is to selectively provide an increase or decrease of oil pressure supplied to the hydraulic valve lifters of an internal combustion engine to change the amount of lift and/or actuation duration provided to the valves under certain selected engine RPM conditions.

Yet a further object of this invention is to provide a secondary source of engine lubricating oil in the event of normal engine oil pump failure when using an independent hydraulic valve lifter actuating oil supply.

These and other objects and advantages of the invention will become apparent to those in this art from the following disclosure of the embodiment of the invention thereof illustrated in the attached drawing Figures.

BRIEF DESCRIPTION OF THE DRAWING FIGURES

FIG. 1 is a schematic showing of a first embodiment of the invention;

FIG. 1*a* is a schematic showing of a second embodiment of the invention;

FIG. 2 is a detailed showing of a typical prior art mechanical cam operated hydraulic valve lifter used to practice the invention.

FIG. 2*a* valve opening and closing duration curve;

FIG. 3 is a schematic showing of an emergency engine auxiliary lubricating oil source; and FIG. 4 is a schematic showing of a second embodiment of the invention;

DETAILED DESCRIPTION OF THE PREFERRED EMBODIMENT OF THE INVENTION

Figure 1:
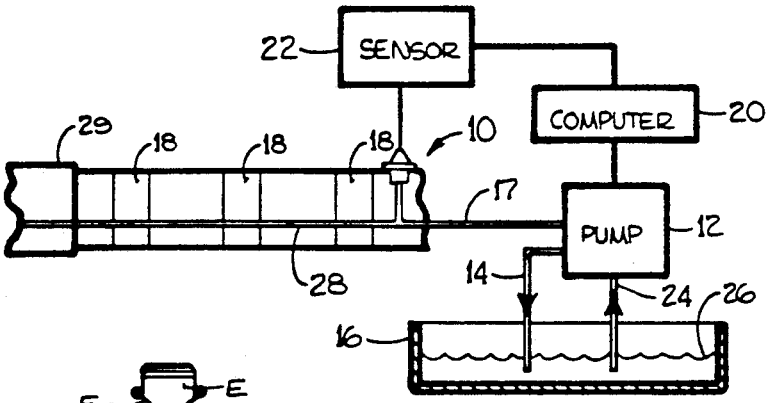

Referring now to the drawing Figures and particularly to drawing FIG. 1 which depicts a schematic showing of a first embodiment of a hydraulic lifter system 10. An oil pump 12, either an electric type operating from the electrical system of the vehicle on which it is installed or a mechanical pump interconnected to the mechanical rotation of the engine which is geared thereto to provide high levels of oil pressure under low engine RPM. The mechanical or constant speed electrical pump is provided with a bypass oil bleed system including a bypass return line 14 extending to the sump 16 which regulates the actual selected pressure to be supplied through pump output line 17 individually to each hydraulic valve lifters 18 or to a common galley. The bleed system for these pumps may include pressure bypass means at each valve or at the common galley, not shown, which is regulated by a controller or computer 20. The controller or computer 20 receives engine RPM information input from a conventional RPM sensor 22 well known in the art as well as manifold pressure and throttle position from appropriate sensing devices. For variable speed electric pumps, motor speed can be varied to supply the precise pressure required.

A detailed cutaway showing of a typical prior art valve lifter 18 can be seen in FIG. 2 and hereinafter discussed in detail. It should be understood that any equivalent type hydraulic valve lifter 18 can be employed to practice this invention.

The actual operation of either type pump described or any other equivalent pump which is employed is controlled by the vehicle onboard controller or computer 20 which is either controlled by engine an RPM derived from RPM sensor 22 or from driver input. The onboard controller or computer can be a typical computer, also referred to as ELECTRONIC CONTROL MODULE (ECM), found on modern automobiles which monitors engine RPM and controls electrical engine timing, smog control and monitoring and other function modernly required of internal combustion engines. An example of such a computer are those manufactured by General Motors, Ford Motors, Chrysler, etc commonly used in current automobile models.

The pump 12 has its oil feed or input line 24 positioned below the normal oil level 26 of the engine oil sump 16 and the bypass or return oil line 14 extends from the pump to a location convenient for drain into the sump. The pump 12 output oil line 17 is connected to the hydraulic lifter supply line 28 generally referred to as the lifter galley cast into the head or block 29 in which the lifters are located and positioned closely adjacent thereto with a small feed aperture between the supply line or galley 28 and the internal mechanism of the lifter discussed in the following description of drawing FIG. 2.

Figure 2:
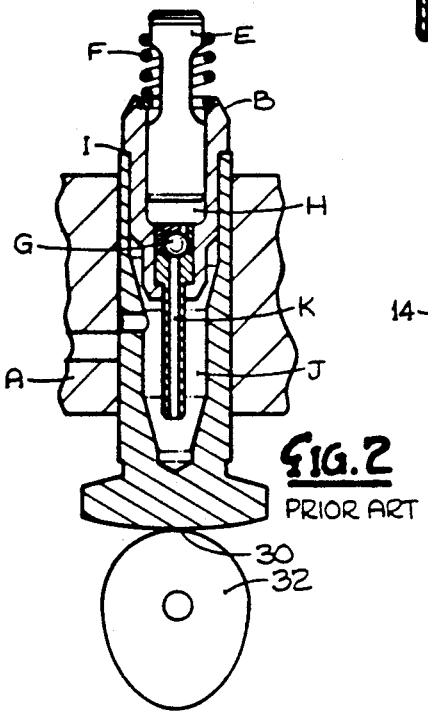
FIG. 2 PRIOR ART

Referring now specifically to drawing FIG. 2 wherein a detailed cross-section of a typical hydraulic valve lifter is shown. The prior showing illustrates the principle of the ZERO-LASH type hydraulic lifter 18. The lifter consists of a cylinder B, plunger E, a ball check valve G and light spring F. Oil from the pump 12 is fed through line 28 through the lifter guide just above A to a supply chamber J in the lifter body, whence it can feed into tube K and past the check valve G into the space H between the bottom of the cylinder B and plunger E. During the closed position of the valve, ie., when the lifter 18 is on the circular or non-lifting part 30 of the cam 32, the spring F begins to lift the plunger E to make contact with the valve stem or rocker arm 34. When the cam 30 begins to lift the lifter (see the valve opening duration curve of FIG. 2A, pressure is increased in the space H, forcing the valve G onto its seat L. The further cam lifting action on the lifter increases the compression chamber H pressure so that the whole assembly acts as a solid member, lifting the associated engine valve from its seat. Any initial air bubbles in the compression chamber H oil leak out through the clearance I, between the plunger and the cylinder. Compensation for wear of the lifter's lifting faces or valve stem or lifter end, are made by allowing a slight leakage of oil, under load between the plunger and the cylinder.

Figure 2A:
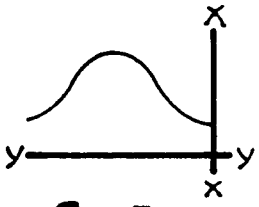

In the present invention, Applicant' equivalent plunger E will be somewhat longer in length, as for example, may translate within the cylinder at least fifty thousandths of an inch and it is possible that the minimum amount of translation at the beginning of the duration curve of FIG. 2A may have a larger distance under certain engine expected operational RPM, ie. for an extremely high RPM engine. Applicant' hydraulic lifter and supporting system operates as follows.

For low RPM lift duration the oil pump 12 produces a low oil pressure so that the compression chamber H is under a low oil pressure whereby the plunger will be required to move a considerable distance under cam action along the duration curve before the engine valve lifts from its seat. On the other hand when a high lift duration is required the pressure is increased from pump 12 and the compression chamber H is under greater pressure which causes the engine valve to unseat quicker and be elevated a greater degree at any location along the duration curve than the valve of the previous low lift example. The amount of pressure required in compression chamber H is determined by the required timing of engine valve openings for the most efficient engine operation. The invention further compensates for low normal engine developed oil pressure due to wear, etc. which over the life of the engine gradually reduces engine efficiency.

Figure 1A:
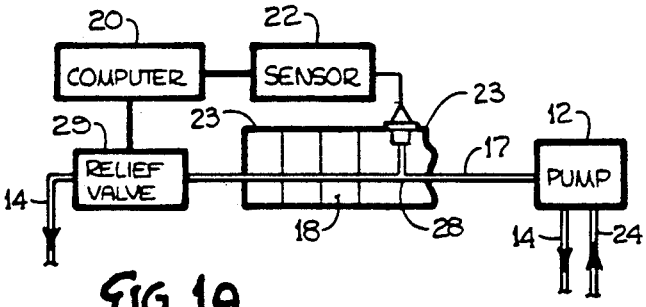

It should be understood that the hydraulic lifter oil supply pressure could be controlled equally as well if a computer controlled pressure relief valve 29 is positioned at the end of the hydraulic valve oil common galley or individual galleys at each lifter galleys remote from the oil input end thereof as shown in drawing FIG. 1*a*.

Figure 3:
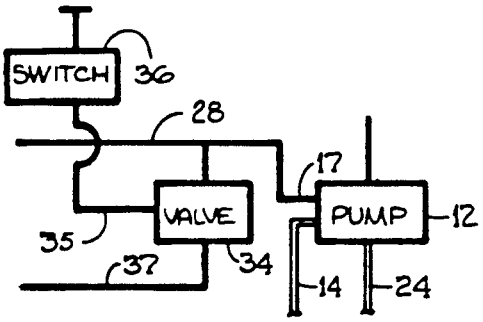

Referring now specifically to drawing FIG. 3 which depicts a schematic showing of the auxiliary source of lubricating oil under pressure for engine lubrication in the event of internal engine lubricating oil pump failure to provided lubrication oil necessary for engine operation. The auxiliary oil pump 12 can supply a quantity of lubrication oil to the engine moving parts for at least a sufficient time to prevent engine over heating or freeze up. In operation the pump 12, of the electric type supplies oil to the hydraulic valve lifters via oil supply line 17. Intermediate the pump 12 and the lifter block or head supply line 28 is positioned an electric valve 34 which is normally closed and requires a ground on electric line 35 to change states to an open condition. When the oil pressure light 39 on the vehicle dash board illuminates due to low or no engine oil pressure, a ground condition on electrical line 35 exists and the valve 34 opens allowing oil under normal pump 12 pressure to flow into oil line 37 which extends to the engine oil lubrication system supplying the main, rod, cam bearings, etc.

Figure 4:
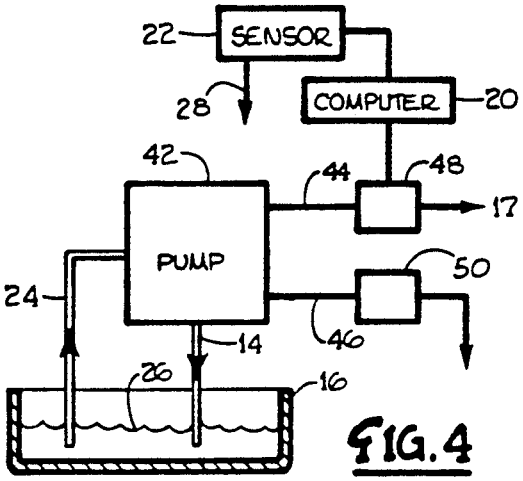

Referring now specifically to drawing FIG. 4 which depicts the schematic showing of a second embodiment. In this embodiment an oil pump 42 having an oil pressure volume output in excess of the normally desired engine oil pressure replaces the conventional oil pump in a given engine. The output of the pump is bifurcated into separate output lines 44 and 46. Line 44 inputs a pressure regulator valve 48 the out put pressure level into line 17 is controlled by computer 20 and sensor 22 as aforementioned. Line 46 inputs a pressure regulator 50 well known in the fluid regulating art which prevents the normal engine lubrication pressure from exceeding its required pressure.

While there have been shown and described preferred embodiments of the hydraulic valve lifter system in accordance with the invention, it will be appreciated that many changes and modifications may be made therein without, however, departing from the essential spirit thereof.

What is claimed is:

1. In an internal combustion engine having hydraulic valve lifters comprising:

a source of pressurized oil for operating said hydraulic valve lifters and means for selectively varying elevating and lowering the pressure of said pressurized oil through a range of different selected pressure levels during operation of said hydraulic valve lifters, said selected pressure determined by the operational requirements of said internal combustion engine.

2. The invention as defined in claim 1 wherein said engine includes an engine oil pump and said source of pressurized oil is supplied from an auxiliary oil pump.

3. The invention as defined in claim 2 wherein said auxiliary oil pump is provided with control means for varying the output oil pressure therefrom independent of engine RPM.

4. The invention as defined in claim 1 wherein the means for selectively varying elevating or lowering the pressure of the oil supplied to the hydraulic lifters is computer controlled.

5. The invention as defined in claim 2 additionally comprising switching means for supplying pressurized oil from said auxiliary pump to the engine for lubrication thereof in the event that said engine oil pump fails to supply said oil for lubrication.

6. The invention as defined in claim 1 wherein said source of pressurized oil is derived from a higher than normal output conventional engine oil pump.

7. The invention as defined in claim 1 wherein said engine includes a galley means having an input end for supplying oil under pressure to said hydraulic lifters and an and output end for returning oil to said source, said means for selectively varying elevating and lowering the pressure of said pressurized oil is located at said output end of said galley.

8. The invention as defined in claim 1 wherein the lift of said hydraulic lifters are selectively infinitely variable in lift height during the valve opening duration by selectively varying lowering or elevating the pressure of said high pressure oil delivered to said lifters.

9. The invention as defined in claim 1 wherein the lift of said hydraulic lifters are selectively infinitely variable in duration during the valve opening duration by selectively varying.lowering or elevating the pressure of said high pressure oil delivered to said lifters.

10. The invention as defined in claim 7 wherein said galley means comprises a common galley for a plurality of said hydraulic lifters.

11. The invention as defined in claim 1 wherein said operational requirements of the engine comprise engine RPM.

* * * * *